US009458790B2

(12) United States Patent
Kees et al.

(10) Patent No.: US 9,458,790 B2
(45) Date of Patent: Oct. 4, 2016

(54) METHOD OF RECUPERATING ENERGY FROM A MOTOR VEHICLE

(71) Applicant: Ford Global Technologies, LLC, Dearborn, MI (US)

(72) Inventors: Donatus Andreas Josephine Kees, Billericay (GB); Stuart Alexander Lane, Stratford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 259 days.

(21) Appl. No.: 14/162,659

(22) Filed: Jan. 23, 2014

(65) Prior Publication Data

US 2014/0229047 A1 Aug. 14, 2014

(30) Foreign Application Priority Data

Feb. 14, 2013 (GB) ..... 1302601.8

(51) Int. Cl.

| | |
|---|---|
| ***F02D 41/30*** | (2006.01) |
| ***F02D 41/12*** | (2006.01) |
| ***F02D 41/38*** | (2006.01) |
| ***F02M 59/02*** | (2006.01) |
| ***F02M 63/02*** | (2006.01) |

(52) U.S. Cl.

CPC ..... *F02D 41/3082* (2013.01); *F02D 41/123* (2013.01); *F02D 41/3005* (2013.01); *F02D 41/3076* (2013.01); *F02D 41/3845* (2013.01); *F02M 59/022* (2013.01); *F02M 63/0225* (2013.01); *F02D 2200/0602* (2013.01); *F02M 2200/40* (2013.01); *Y10S 903/905* (2013.01)

(58) Field of Classification Search

CPC ..... F02D 41/3005; F02D 41/3064; F02D 41/3076; F02D 41/3082; F02D 41/123; F02D 41/3836; F02D 41/3845; F02D 41/3854; F02M 63/0205; F02M 63/022; F02M 63/0225; F02M 59/022; F02M 2200/40

See application file for complete search history.

(56) References Cited

U.S. PATENT DOCUMENTS

| | | | | | |
|---|---|---|---|---|---|
| 4,245,598 | A * | 1/1981 | Ruhl | F02D 17/04 | 123/387 |
| 4,582,039 | A * | 4/1986 | Nishida | F02M 37/0058 | 123/510 |
| 6,712,166 | B2 * | 3/2004 | Rush | B60K 6/12 | 180/165 |
| 7,717,077 | B2 * | 5/2010 | Prior | F02M 55/025 | 123/447 |
| 7,913,791 | B2 * | 3/2011 | Rose | F02N 19/00 | 123/179.31 |
| 2003/0089339 | A1 * | 5/2003 | Schueler | F02M 63/0225 | 123/446 |
| 2003/0089341 | A1 * | 5/2003 | Schueler | F02M 63/025 | 123/457 |
| 2005/0188958 | A1 * | 9/2005 | Klenk | F02M 37/18 | 123/458 |
| 2008/0271707 | A1 * | 11/2008 | Nozaki | F02M 59/44 | 123/446 |
| 2010/0276221 | A1 | 11/2010 | Rose et al. | | |

FOREIGN PATENT DOCUMENTS

| | | | | |
|---|---|---|---|---|
| GB | 2508834 | A * | 6/2014 | F02D 41/3845 |
| JP | H03156160 | A | 7/1991 | |
| JP | 2006348908 | A * | 12/2006 | |
| WO | 2008139268 | A1 | 11/2008 | |
| WO | 2011045519 | A1 | 4/2011 | |

* cited by examiner

*Primary Examiner* — Dale W Hilgendorf

(74) *Attorney, Agent, or Firm* — Julia Voutyras; Alleman Hall McCoy Russell & Tuttle LLP

(57) ABSTRACT

A system and method for recuperating energy from a motor vehicle is described in which during an engine overrun period kinetic energy from the slowing motor vehicle is used to drive a high pressure fuel pump at a high demand level so as to store fuel at high pressure in a fuel accumulator for later use by an engine of the motor vehicle.

18 Claims, 11 Drawing Sheets

METHOD OF RECUPERATING ENERGY FROM A MOTOR VEHICLE

CROSS REFERENCE TO RELATED APPLICATIONS

The present application claims priority to Great Britain Patent Application No. 1302601.8, entitled "A Method of Recuperating Energy from a Motor Vehicle," filed on Feb. 14, 2013, the entire contents of which are hereby incorporated by reference for all purposes.

FIELD

The present description relates to a motor vehicle and in particular to the recuperation of energy from a motor vehicle during a period in which the motor vehicle is slowing.

BACKGROUND AND SUMMARY

It is known to convert kinetic energy into stored electrical energy during a period of time in which a vehicle is slowing down and such systems are sometimes referred to as a regenerative braking system or an energy recuperation system. However, there is increasing pressure on the manufacturers of motor vehicles to reduce fuel consumption.

The inventors herein have recognized issues with such approaches and have recognized an opportunity to further reduce fuel consumption while also potentially reducing exhaust emissions by constructing and using a fuel supply system of a motor vehicle in the manner described herein. For example, the fuel usage of a motor vehicle can be reduced by using a fuel supply system configured to provide a method of recuperating energy from the motor vehicle. In one particular example, the method comprises during a vehicle over-run event wherein substantially no fuel is supplied to an engine, operating a high pressure fuel pump at a high demand level to store fuel in an accumulator, the high pressure fuel pump being engine driven and operable at least at high and low demand levels, and the accumulator being selectively connectable to the high pressure fuel pump and the engine, such that it is connected during some conditions, and not connected during other conditions.

Therefore, according to a first aspect of the present disclosure there is provided a method of recuperating energy from a motor vehicle using a fuel supply system of an engine of the motor vehicle, the fuel supply system including an engine driven high pressure fuel pump operable at least at high and low demand levels and a high pressure fuel accumulator selectively connectable to the high pressure fuel pump and the engine wherein the method comprises, during a vehicle over-run event in which substantially no fuel is being supplied to the engine, operating the high pressure fuel pump at the high demand level and storing fuel from the high pressure fuel pump in the accumulator. As one example, the high demand level is a maximum demand level of the high pressure fuel pump. In this way, the technical result is achieved that allows for further reduction in fuel usage of the motor vehicle.

The method further comprises supplying fuel from the accumulator to the engine during a subsequent engine fuel demand event and operating the high pressure fuel pump at the low demand level during the period in which fuel is being supplied from the accumulator to the engine. The subsequent engine fuel demand event may be an event in which fuel is required by the engine to accelerate the motor vehicle. As one example, the low demand level may be a minimum demand level of the high pressure fuel pump.

The method may further comprise, during the vehicle over-run event, reducing the demand level for the high pressure fuel pump from the high demand level to the low demand level if the accumulator is full. Further still, the method may comprise, during the vehicle over-run event, operating the high pressure fuel pump at the high demand level if the speed of the motor vehicle is above a predefined minimum vehicle speed and operating the high pressure fuel pump at the low demand level if the speed of the motor vehicle is below the predefined minimum vehicle speed.

According to a second aspect of the present disclosure there is provided a fuel supply system of an engine of a motor vehicle comprising a fuel reservoir, a low pressure fuel pump to supply fuel from the reservoir to an engine driven variable output high pressure fuel pump operable at least at high and low demand levels, at least one fuel injector to supply fuel at high pressure to the engine, a fuel accumulator to store fuel at high pressure, a valve means to control the flow of fuel between the high pressure fuel pump, the accumulator and the engine and an electronic controller to control the operation of the high pressure fuel pump, the valve means and the at least one fuel injector, wherein the electronic controller is operable during a vehicle over-run event in which substantially no fuel is being supplied to the engine, to operate the high pressure fuel pump at the high demand level and control the valve means to supply fuel from the high pressure fuel pump to the fuel accumulator.

As described above, in one example, the high demand level may be a maximum demand level of the high pressure fuel pump, wherein the maximum demand level selected to deliver a maximum flow of fuel from the high pressure fuel pump based on an engine speed. Furthermore, during a subsequent engine fuel demand event, the valve means may be controlled by the electronic controller to supply fuel from the accumulator to the engine and the high pressure fuel pump may be operated by the electronic controller at the low demand level during the period in which fuel is being supplied from the accumulator to the engine. The subsequent engine fuel demand event may be an event in which fuel is required by the engine to accelerate the motor vehicle while the low demand level may be a minimum demand level of the high pressure fuel pump. In addition, during the vehicle over-run event, the electronic controller may be further operable to reduce the demand level for the high pressure fuel pump from the high demand level to the low demand level if the accumulator is full. Further still, during the vehicle over-run event, the electronic controller may operate the high pressure fuel pump at the high demand level if the speed of the motor vehicle is above a predefined minimum vehicle speed and may operate the high pressure fuel pump at the low demand level if the speed of the motor vehicle is below the predefined minimum vehicle speed.

According to a third aspect of the present disclosure there is provided a motor vehicle having a fuel supply system constructed in accordance with said second aspect of the present disclosure just described. As one example, the motor vehicle may be a hybrid motor vehicle having at least one electrical traction motor to assist with driving of the motor vehicle and an electrical generator to recuperate energy from the motor vehicle and store it for subsequent use by the at least one electrical traction motor wherein, when the speed of the motor vehicle is above a predefined minimum vehicle speed during the vehicle over-run event, the fuel supply system is used to recuperate energy from the motor vehicle by storing fuel in the accumulator and simultaneously the electrical generator is used to recuperate energy from the motor vehicle and, when the speed of the motor vehicle is below the predefined minimum vehicle speed, the generator is used to recuperate energy from the motor vehicle and store it as electrical energy and the electronic controller operates the high pressure fuel pump at the low demand level. In one example, the traction motor and the generator may be integrated into a single electrical machine.

The above advantages and other advantages, and features of the present description will be readily apparent from the following Detailed Description when taken alone or in connection with the accompanying drawings. It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
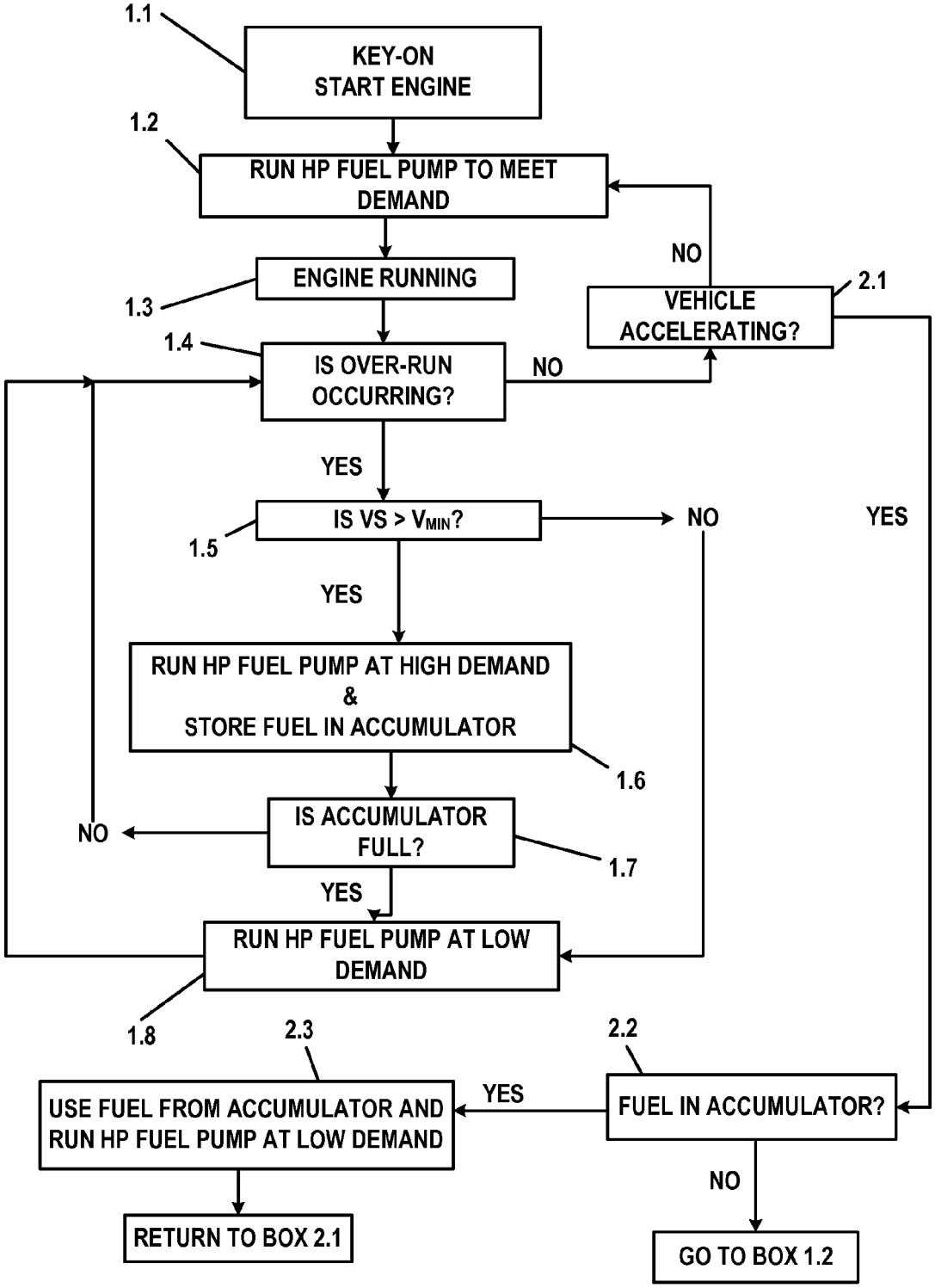
FIG. 1 is a high level flowchart showing a method of controlling a fuel system of an engine of a motor vehicle in accordance with a first aspect of the present disclosure.
Figure 2:
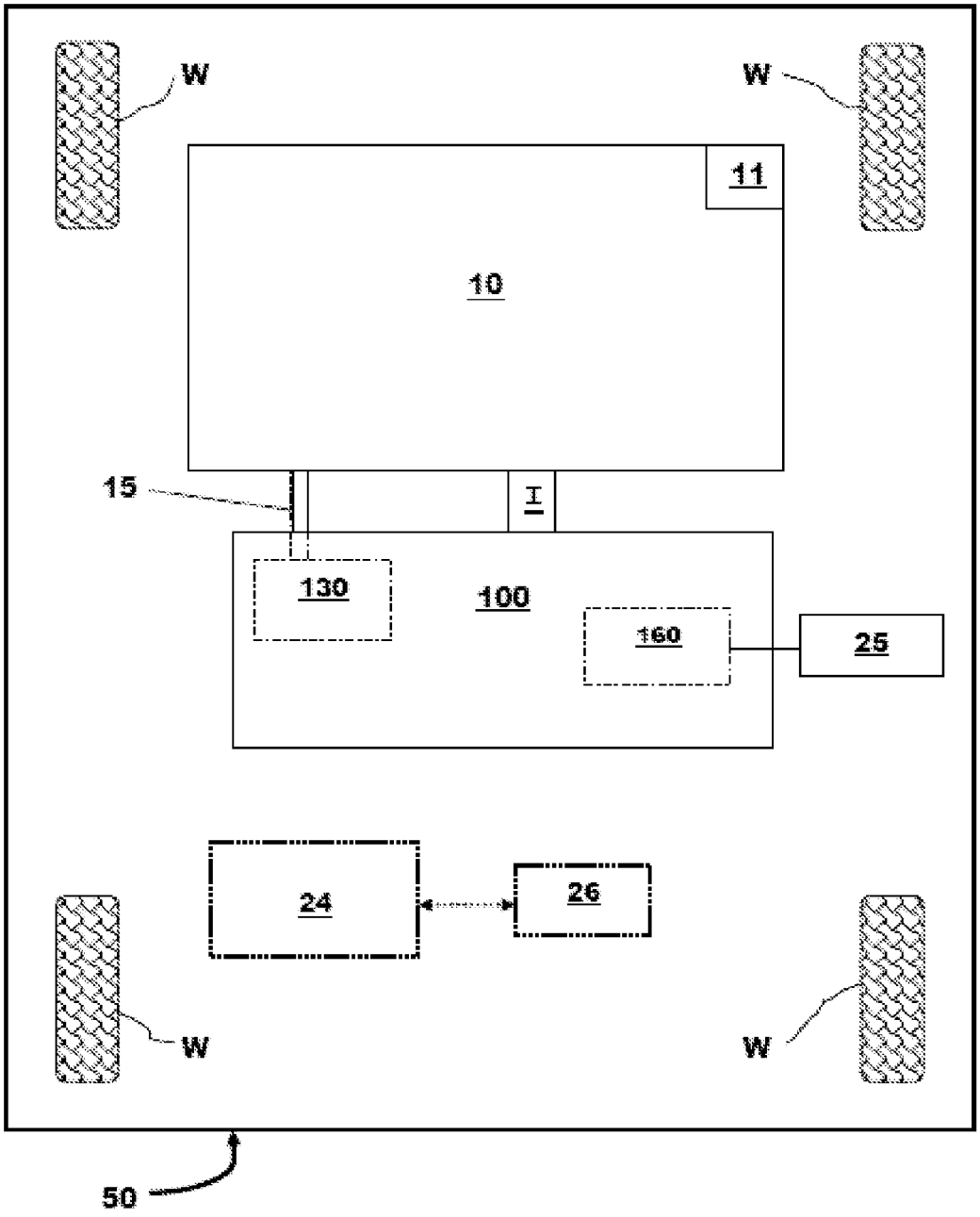
FIG. 2 is a schematic plan view of a motor vehicle according to a third aspect of the present disclosure having a fuel supply system according to a second aspect of the present disclosure.

With reference to FIG. 1 there is shown a high level flow chart of a method of controlling a fuel supply system of an engine of a motor vehicle according to the present disclosure such as the engine shown in FIG. 2 and the fuel supply system shown in FIGS. 3 to 6.

The method starts at box 1.1 which includes a manual key-on event and an engine start event. The method then advances to box 1.2 where the engine is running and a high pressure fuel pump of a fuel supply system is operated at a demand level to meet the running requirements of the engine and then on to box 1.3 where the engine is running.

Then, in box 1.4 it is determined whether over-run of the engine is occurring. Over-run of an engine occurs when the motor vehicle is decelerating, there is no demand for fuel to be supplied to the engine and engine braking of the motor vehicle is occurring. Engine braking occurs where the engine absorbs torque transferred from the wheel, back through the transmission, to the engine, where even if the engine generates combustion torque, that torque is insufficient to overcome friction and thus the net crankshaft torque is negative. In an over-run condition, the torque from the wheels generated through vehicle inertia and/or gravity, it transferred through the transmission and torque converter, if present, to act to rotate the engine, as well as any components also rotating with the engine, such as a high pressure fuel pump driven by a cam of the engine. Most modern engines have an over-run fuel cut-off system arranged such that, in the event of an over-run condition being detected, the fuel supply to the engine is cut-off. Therefore one way of detecting whether an engine is in over-run condition is to use the over-run fuel cut-off system to provide an indication as to when over-run is occurring. An alternative method for determining whether engine over-run is present is to monitor the position of an accelerator pedal or throttle valve, and driveline between the engine and the road, e.g., clutch engagement state and transmission engagement state. For an engine over-run state to be present, the driveline between the engine and the road is in a driving state, e.g., clutch engaged and transmission in-gear while the accelerator pedal is not pressed. Further, the transmission gear selected should be one which does not have an over-running clutch, and the torque converter is locked.

Dealing firstly with a situation in which over-run is not occurring, the method advances from box 1.4 to box 2.1.

In box 2.1 it is determined whether the motor vehicle is accelerating. If the motor vehicle is not accelerating then the method returns to box 1.2 otherwise it advances to box 2.2 to determine whether there is any fuel stored in a high pressure fuel accumulator which forms part of the fuel supply system. If there is no fuel stored in the accumulator then the method returns to box 1.2 and the high pressure fuel pump is run normally to meet the current demands of the engine. However, if in box 2.2 it is determined that there is fuel in the accumulator or more fuel than a predefined minimum then the method advances to box 2.3 where the high pressure fuel pump is operated at a low demand level and fuel stored in the accumulator is supplied to the engine.

The method then returns to box 2.1 to recheck whether the motor vehicle is accelerating after which the logic previously described with respect to box 2.1 is applied.

Therefore during a period of motor vehicle acceleration fuel is supplied to the engine from the accumulator until either the fuel in the accumulator runs out or the period of acceleration ends. This has the advantage that the load imposed on the engine is reduced thereby permitting the engine and hence the motor vehicle to accelerate more quickly but also reducing the amount of fuel used because the engine does not have to drive the high pressure fuel pump.

Returning now to box 1.4, if it is determined that the engine is overrunning, the method advances from box 1.4 to box 1.5. In box 1.5 it is checked whether the speed (Vs) of the motor vehicle is greater than a predetermined low speed limit (Vmin). The value of Vmin can in some case be zero kilometers per hour (km/h) but in other cases be a value greater than zero as will be described hereinafter in greater detail.

Dealing firstly with a situation in which the speed of the motor vehicle is greater than Vmin, the method advances from box 1.5 to box 1.6. In box 1.6 the high pressure fuel pump is operated at a high demand level and the fuel pumped by the pump is stored in the high pressure fuel accumulator and is not supplied to the engine.

By operating the high pressure fuel pump at a high demand level this acts as a brake on the engine thereby increasing the engine braking effect on the motor vehicle and, more importantly, the fuel supplied to the accumulator is supplied with no fuel penalty because the kinetic energy of the motor vehicle is being used via the engine to drive the high pressure fuel pump. Therefore no additional fuel is used by the engine to fill the accumulator and the emissions from the engine will be reduced.

From box 1.6 the method advances to box 1.7 which is an optional step. In some alternative embodiments the high pressure fuel pump is run continuously at the high demand level during an engine overrunning situation and any excess fuel is overflowed back to a fuel storage tank of the fuel supply system. However, such fuel oversupply will waste some of the kinetic energy of the motor vehicle which could be recovered by other means such as, for example, regenerative braking or electrical energy storage.

Therefore in this case, as shown in box 1.7, if it is determined the accumulator is not full, the method returns to box 1.4. If the vehicle is no longer in motion it cannot be overrunning or accelerating and so from box 1.4 it will return to box 1.2. If the vehicle is still in motion then the logic described above with reference to box 1.4 is applied. However, if in box 1.7, it is determined that the accumulator is full, then the method advances from box 1.7 to box 1.8 where the high pressure fuel pump is run at a low demand level and preferably a zero demand level so that the amount of fuel that has to be returned to the fuel storage tank is minimized.

Box 1.8 can also be accessed via box 1.5 if the motor vehicle speed Vs is determined to be below the minimum speed Vmin. That is to say, when the vehicle speed Vs is less than the minimum speed Vmin the high pressure fuel pump is operated at a low demand level increasing the opportunity for energy recuperation by other means such as electrical energy recuperation.

From box 1.8 the method returns to box 1.4. As before, if the vehicle is no longer in motion, it cannot be overrunning or accelerating and so from box 1.4 it will return to box 1.2. Otherwise the logic described above with reference to box 1.4 is applied.

It will be appreciated that the above method can be ended at any time by a manual key-off event. In the event of a manual key-off event occurring fuel may remain stored in the accumulator. If this is the case then following the next engine start-up occurring (e.g., the next execution of box 1.1) fuel is already stored in the accumulator that can be used by the engine for starting the engine and accelerating the motor vehicle from rest. The use of fuel from the accumulator during a cold start is advantageous in that it reduces the cranking load due to the lack of torque required to drive the high pressure fuel pump.

It will be appreciated that the present disclosure is not limited to the steps or order of execution shown in FIG. 1. For example, although in the example shown fuel is used from the accumulator when the motor vehicle is accelerating, this need not be the case and the fuel from the accumulator could be used during cruising or idling of the motor vehicle. In addition the steps shown in boxes 1.5, 1.7 and 1.8 could be omitted so that the high pressure fuel pump is always operated at a high demand level during an overrun event.

With particular reference to FIG. 2 there is shown a motor vehicle 50 having four road wheels 'W', a diesel engine 10 and a fuel supply system 100 for the engine. Although the present disclosure is described with reference to a diesel engine it will be appreciated that it could be applied to other engine types that utilize a high pressure fuel injection system such as, for example and without limitation, a direct injection gasoline engine.

The engine 10 is driveably connected in this case to two of the road wheels by a transmission (not shown) but it will be appreciated that the transmission could in other embodiments driveably connect the engine 10 to all four of the road wheels 'W'. It will also be appreciated that the present disclosure is not limited to use with a four wheeled road vehicle and could be applied to a vehicle having two wheels or more than four wheels.

A hybrid drive system is shown in dotted outline on FIG. 2 comprising a drive motor 24 and an electric energy storage device such as a battery 26. These features are optional in that the motor vehicle 50 can be a conventional motor vehicle or can be a hybrid motor vehicle when fitted with the hybrid drive system 24, 26. It will be appreciated that the motor 24 is connected in some manner to one or more of the wheels 'W' or to the engine 10 so as to be able to selectively provide tractive drive to the motor vehicle 50.

A starter motor 11 is provided to start the engine 10. It will however be appreciated that any suitable cranking means could be used.

The fuel system 100 receives a number of vehicle information inputs 25 that are used by the fuel supply system 100 to control the fuelling of the engine 10 via one or more fuel injectors 'I'. Such inputs 25 are well known in the art and may include, for example and without limitation, engine speed, driver demand, mass air flow, air temperature, coolant temperature, ambient temperature and ambient atmospheric pressure.

The fuel supply system includes an electronic controller 160 and an engine driven variable output high pressure fuel pump 130 that is driven, as is well known in the art, by a mechanical drive 15 from one end of a camshaft (not shown) of the engine 10. It will however be appreciated by those skilled in the art that other mechanical drive means could be used and that the present disclosure is not limited to the use of a camshaft driven high pressure fuel pump 130.

Variable output high pressure fuel pumps are known from, for example and without limitation, US Patent Application 20120177505 and PCT patent publication WO-2012113488.

The fuel supply system 100 is described in greater detail with reference to four embodiments shown in FIGS. 3 to 6 respectively hereinafter.

Although the electronic controller 160 of the fuel supply system 100 is shown in FIG. 2 as a separate unit it will be appreciated that it could be embodied as part of another electronic controller such as a powertrain controller.

Figure 3:
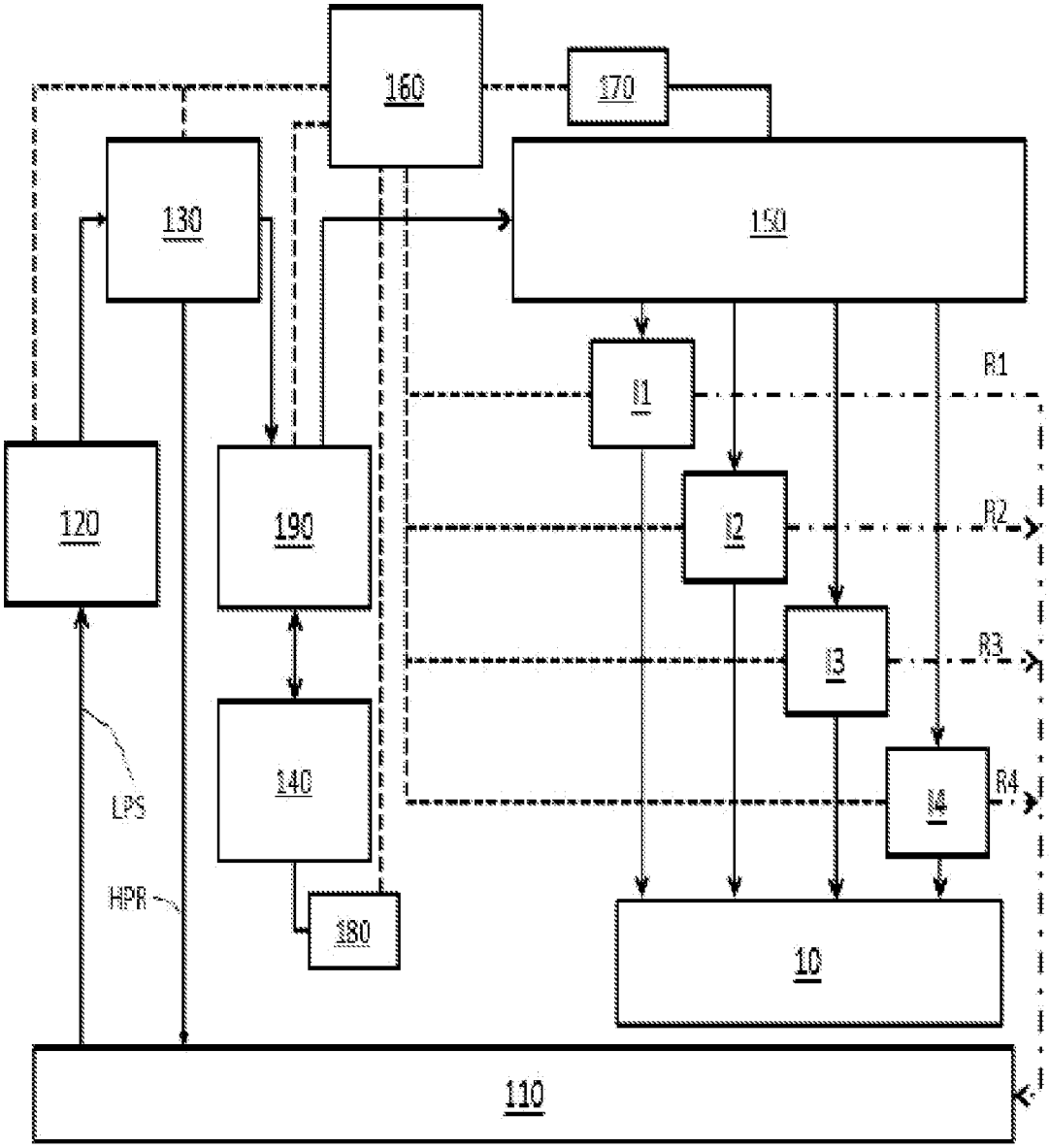
FIG. 3 is a block diagram representation of a first embodiment of the fuel supply system shown in FIG. 2.

Referring now to FIG. 3 there is shown in greater detail a first embodiment of the fuel supply system shown in FIG. 2.

The fuel supply system 100 comprises a fuel reservoir or fuel tank 110 used to store fuel for use by the engine 10. Fuel is drawn from the fuel tank 110 by a low pressure fuel pump 120 and is supplied to an inlet of the variable output high pressure fuel pump 130 via a low pressure fuel supply line LPS. The high pressure fuel pump 130 is controlled by the electronic controller 160 between a minimum demand level and a maximum demand level. The minimum demand level will preferably result in a fuel flow rate from the high pressure fuel pump 130 of substantially zero and the maximum demand level will result in the maximum possible flow from the high pressure fuel pump 130 for the current engine speed. When operating at the minimum demand level, the high pressure fuel pump 130 requires a minimal driving force to be provided from the engine 10 and, when operating at the maximum demand level, the high pressure fuel pump 130 requires a high driving force to be supplied from the engine 10. Excess or leaked fuel from the high pressure fuel pump 130 is returned to the fuel tank 110 via a high pressure return line HPR.

A valve means in the form of a single electronically controlled three way diverter valve 190 is connected to an output from the high pressure fuel pump 130 so as to receive a flow of fuel at high pressure therefrom.

Figure 10A:
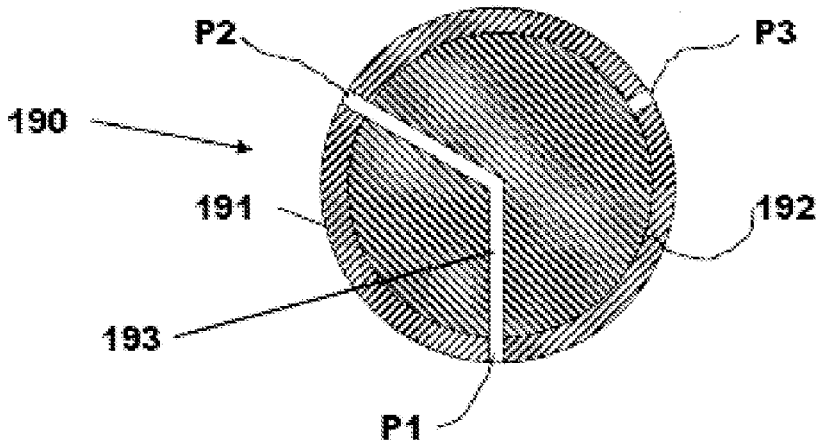
FIGS. 10A to 10C are diagrammatic representations of a high pressure fuel flow diverter valve showing the valve in three different flow path states.
Figure 10B:
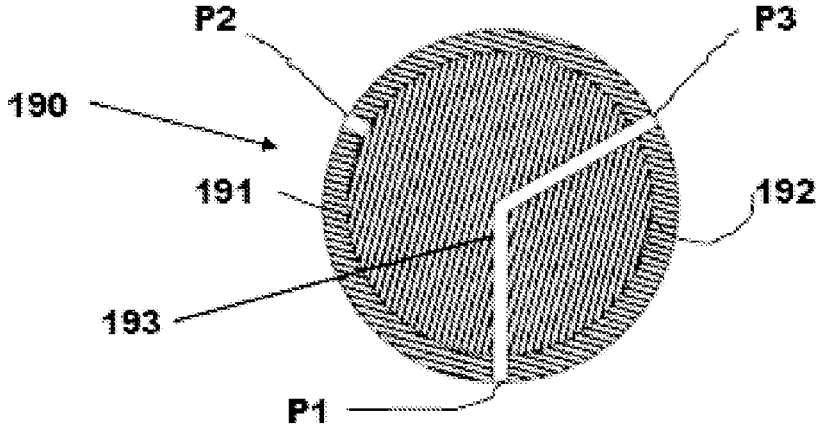
Figure 10C:
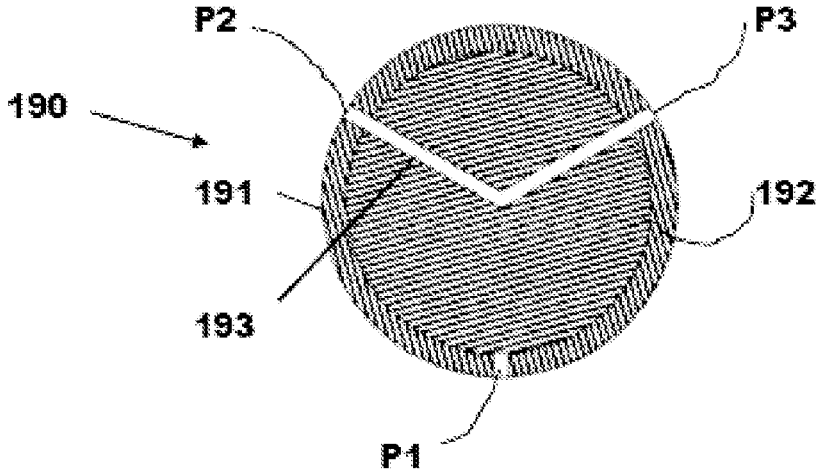

The diverter valve 190 is now described with reference to FIGS. 10A to 10C in an example valve that has three selectable fuel flow paths. By way of example, a rotary diverter valve 190 is shown in FIGS. 10A to 10C having a body 191 in which is rotatably mounted a valve member 192 defining a fuel flow passage 193. The body 191 has first port P1 connected to the high pressure fuel pump 130, a second port P2 connected to a common fuel rail 150 and a third port P3 connected to a high pressure fuel accumulator 140.

The diverter valve 190 is interposed between the high pressure fuel pump 130 and the common fuel rail 150, between the high pressure fuel pump 130 and the accumulator 140 and between the accumulator 140 and the common fuel rail 150.

In FIG. 10A the valve member 192 is shown in a position in which the fuel flow passage 193 defines a first flow path connecting the high pressure fuel pump 130 to the common fuel rail 150.

In FIG. 10B the valve member 192 is shown in a position in which the fuel flow passage 193 defines a second flow path connecting the high pressure fuel pump 130 to the accumulator 140.

In FIG. 10C the valve member 192 is shown in a position in which the fuel flow passage 193 defines a third flow path connecting the accumulator 140 to the common fuel rail 150.

The valve member 192 is rotatable by an electric actuator (not shown) in response to a control input from the electronic controller 160 so that the selection of flow path is controlled by the electronic controller 160.

It will be appreciated that alternative forms of three way diverter valve could be constructed and that the present disclosure is not limited to the rotary diverter valve 190 shown in FIGS. 10A to 10C.

Referring back now to FIG. 3, the common fuel rail 150 is arranged to supply fuel to four fuel injectors I1, I2, I3 and I4, the operation of each of which is controlled by the electronic controller 160.

Each of the fuel injectors I1, I2, I3 and I4 supplies fuel to the engine 10 at the timing and volume required based upon a respective control input received from the electronic controller 160. Excess fuel from the fuel injectors I1, I2, I3 and I4 is returned to the fuel tank 110 via respective low pressure return lines R1, R2, R3 and R4.

It will be appreciated that the present disclosure is not limited to use with four fuel injectors and that a fuel supply system having less or more fuel injectors could beneficially utilize the present disclosure.

A fuel pressure sensor 170 is arranged to sense the pressure of fuel in the common fuel rail 150 and supply a signal indicative of the sensed pressure to the electronic controller 160.

Figure 11A:
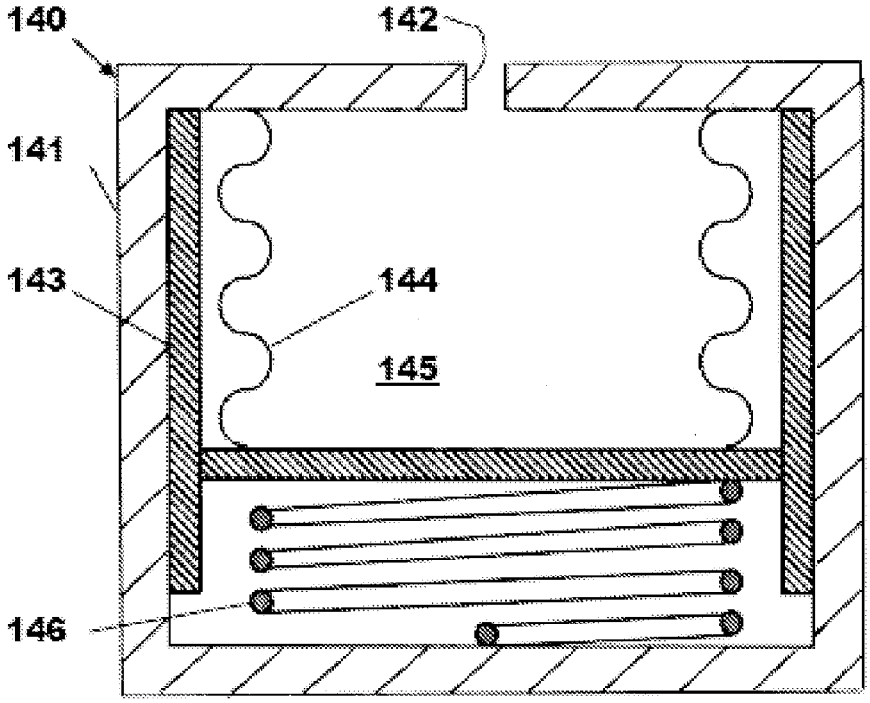
FIGS. 11A and 11B are diagrammatic representations of a high pressure fuel accumulator suitable for use in a fuel supply system constructed in accordance with said second aspect of this present disclosure.
Figure 11B:
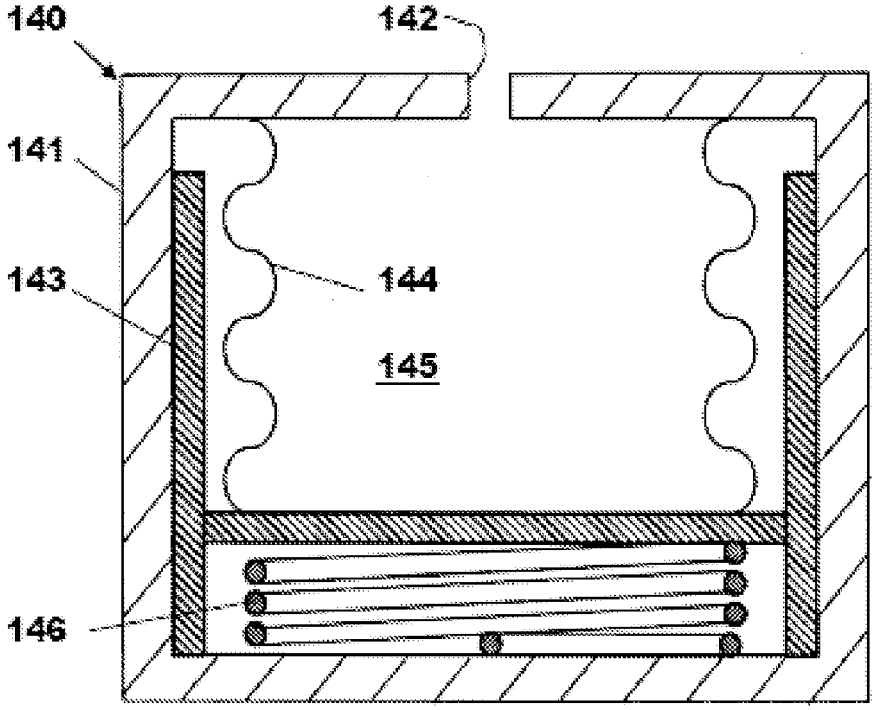

The high pressure accumulator 140 can be of any suitable construction. U.S. Pat. No. 7,717,077 discloses a free piston acted on by a spring for use as a fuel accumulator. Such an arrangement would be suitable for use but it is preferred if a sealed bellows type of accumulator such as that shown in FIGS. 11A and 11B is used because with such an accumulator no fuel can leak from the accumulator whereas with the free piston accumulator shown in U.S. Pat. No. 7,717,077 there is the potential for fuel to leak past the piston.

The accumulator 140 is shown in FIG. 11A in an empty state and in FIG. 11B in a full state. The accumulator comprises a body 141 defining a flow passage 142 by which fuel can enter or leave a storage volume 145 defined by a cup shaped piston, a metal bellows 144 and the body 141. The piston 143 supports the bellows 144 and is slidingly supported by the body 141. A spring 146 biases the piston 143 towards the end of the body 141 at which fuel enters or leaves the storage volume 145 via the flow passage 142. The bellows 144 is sealed to both the body 141 and the piston 143 and so there is no possibility of leakage of fuel. It will be appreciated that in practice the body 141 will not be a single component but will be constructed to enable assembly of the various components 143, 144, 146.

A fuel pressure sensor 180 is arranged to sense the pressure of fuel in the accumulator 140 and supply a signal indicative of the sensed pressure to the electronic controller 160.

Figure 4:
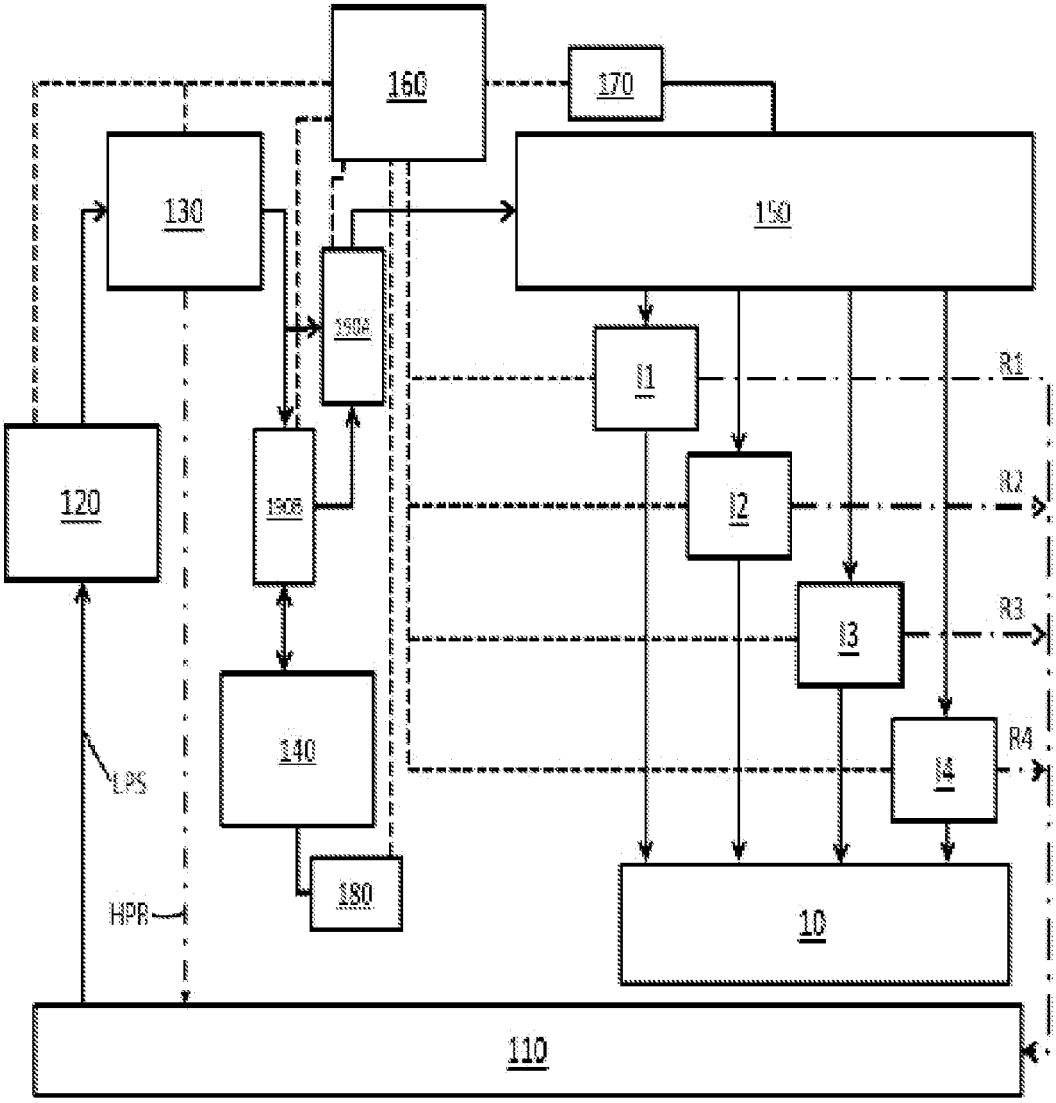
FIG. 4 is a block diagram representation of a second embodiment of the fuel supply system shown in FIG. 2.
Figure 5:
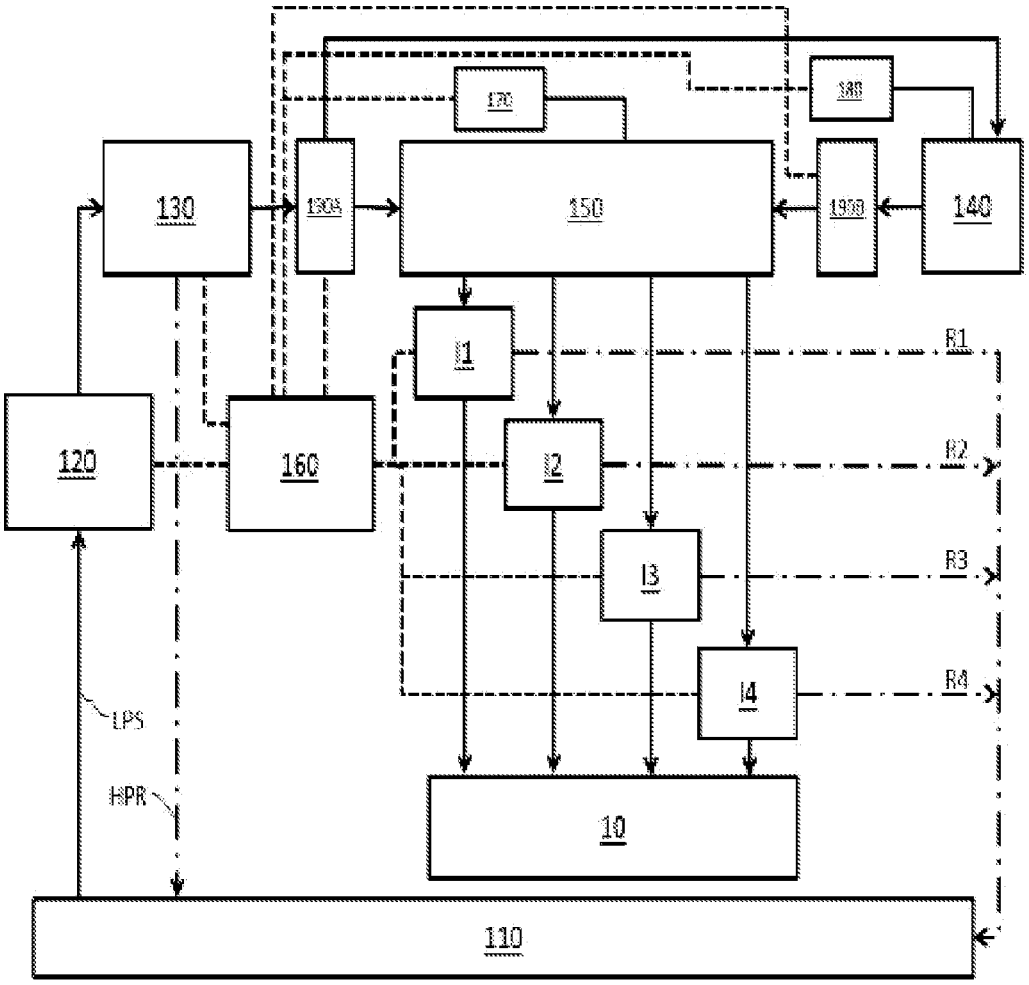
FIG. 5 is a block diagram representation of a third embodiment of the fuel supply system shown in FIG. 2.
Figure 6:
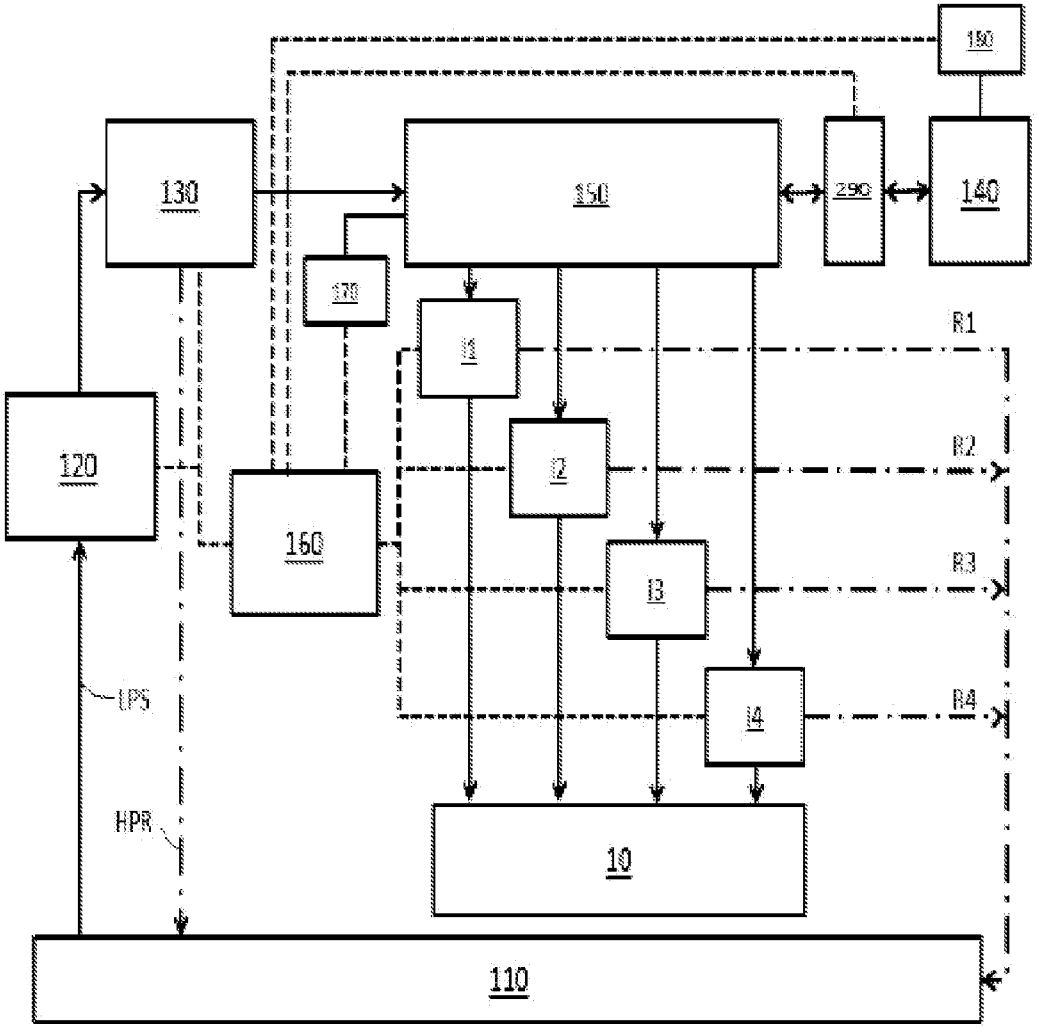
FIG. 6 is a block diagram representation of a fourth embodiment of the fuel supply system shown in FIG. 2.

FIGS. 4 to 6 show, respectively, second, third and fourth embodiments of a fuel supply system according to the present disclosure.

All of these embodiments are in most respects similar to the first embodiment shown in FIG. 3 and comprise of similar components with the exception of the type and arrangement of the valve means.

In the second embodiment shown in FIG. 4, the valve means comprises first and second valves 190A and 190B. The first valve 190A is a two way valve that either permits fuel to flow from the high pressure fuel pump 130 to the common fuel rail 150 or from the second valve 190B to the common fuel rail 150. The second valve 190B is a two way valve that either permits fuel to flow from the high pressure fuel pump 130 to the accumulator 140 or from the accumulator 140 to the first valve 190A.

In the third embodiment shown in FIG. 5, the valve means comprises first and second valves 190A and 190B. The first valve 190A is a two way valve that either permits fuel to flow from the high pressure fuel pump 130 to the common fuel rail 150 or from the high pressure fuel pump 130 to the accumulator 140. The second valve 190B is a one way valve that either permits or prevents fuel flow from the accumulator 140 to the common fuel rail 150.

In the fourth embodiment shown in FIG. 6, the valve means comprises a single valve 290. The valve 290 either permits or prevents fuel flow between the accumulator 140 and the common fuel rail 150. In this embodiment the accumulator 140 is filled via the common fuel rail 150.

Operation of the fuel supply system 100 shown in FIG. 3 will now be described with reference to FIGS. 7A to 7D.

Figure 7A:
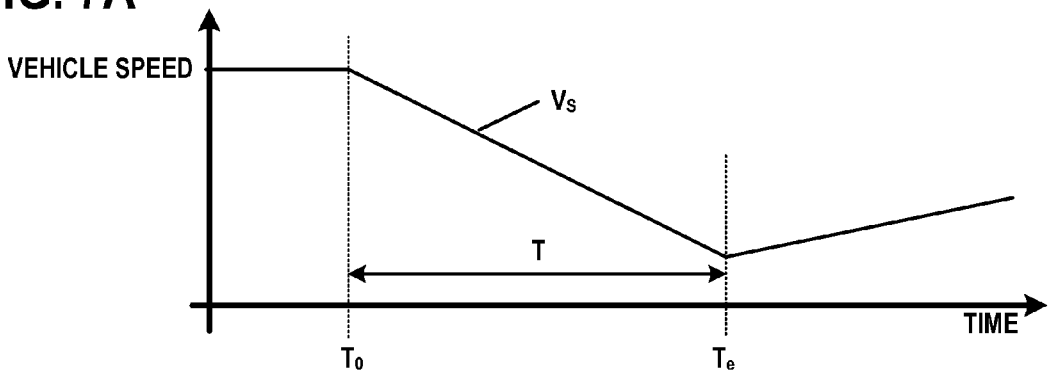
FIGS. 7A to 7D are time charts showing the variation of vehicle speed, fuel pump demand, fuel accumulator loading and fuel injection quantity during a period in which the motor vehicle is slowing down and then subsequently accelerating.
Figure 7B:
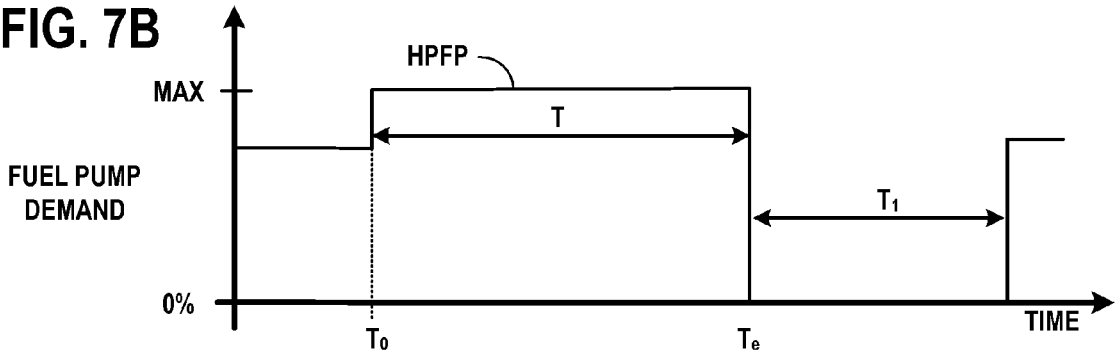
Figure 7C:
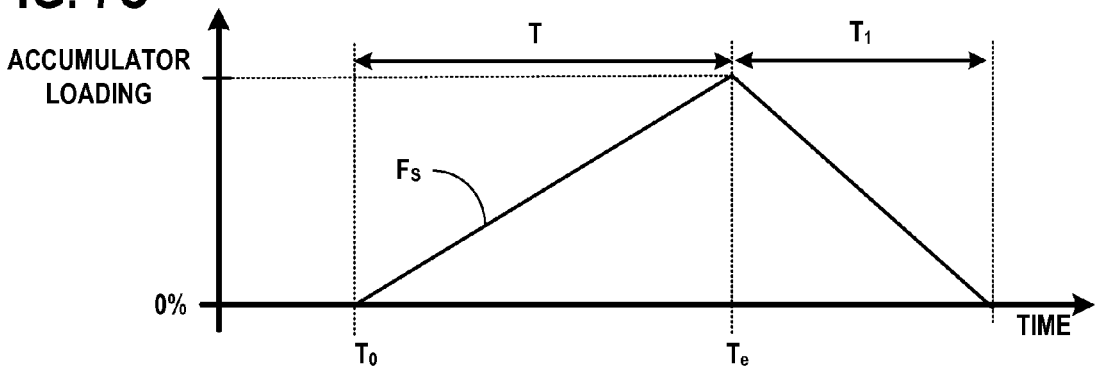
Figure 7D:
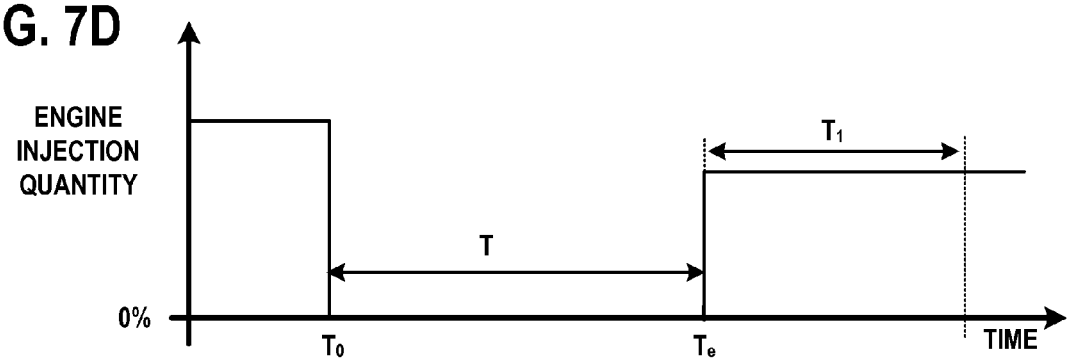

FIG. 7A shows a relationship between vehicle speed and time during a period of time in which the motor vehicle 50 slows down and then, during a subsequent engine fuel demand event, accelerates. FIGS. 7B, 7C and 7D show respectively the variations in high pressure fuel pump demand, fuel accumulator loading and engine fuel injection quantity during the same period of time.

During the time period starting at time T0 and ending a time Te the motor vehicle 50 is decelerating and the engine 10 is in an overrunning state. Prior to time T0 the electronic controller 160 controls the fuel injectors I1, I2, I3 and I4 so as to provide fuel at the correct timing and volume to the engine 10, sets the demand level for the high pressure fuel pump 130 to a level required to satisfy the fuel usage needs of the engine 10 and controls the three way diverter valve 190 so that it adopts the position shown in FIG. 10A with the valve member 192 in a position in which the fuel flow passage 193 provides a flow path connecting the high pressure fuel pump 130 to the common fuel rail 150.

While in this operating state the fuel supply system 100 operates as a conventional fuel supply system with fuel being drawn from the fuel tank 110 by the low pressure fuel pump 120, supplied to the high pressure fuel pump 130 from the low pressure fuel pump 120, pressurized by the high pressure fuel pump 130 under the control of the electronic controller 160, supplied to the common fuel rail 150 from the high pressure fuel pump 130 and drawn from the common fuel rail 150 by the fuel injectors I1, I2, I3 and I4 for injection into the engine 10 to meet the current operating demands of the engine 10.

At time T0 the electronic controller 160 receives an indication that an overrunning state is present for the engine 10 either from an engine fuel cut-off system or by direct measurement of various motor vehicle and engine parameters. At time T0 the engine speed Vs is greater than the predefined minimum speed which in this case is set to zero km/h. Therefore in response to this indication of overrunning, the electronic controller 160, switches off the fuel injectors I1, I2, I3, I4, sets the demand level for the high pressure fuel pump 130 to a high level, preferably a maximum demand level, and controls the three way diverter valve 190 so that the valve member 192 adopts the position shown in FIG. 10B in which the fuel flow passage 193 defines a flow path connecting the high pressure fuel pump 130 to the accumulator 140. Fuel is then pumped into the accumulator 140 from the high pressure fuel pump 130 until the overrunning event ends at time Te or until the accumulator is full. The situation in the event of a full accumulator 140 is described hereinafter with reference to FIGS. 9A to 9C.

At time Te a fuel demand is generated and the valve member 192 is commanded by the electronic controller 160 to adopt the position shown in FIG. 10C so as to connect the accumulator 140 to the common fuel rail 150 thereby facilitating the supply of fuel from the accumulator 140 to the common fuel rail 150.

In FIG. 7B the demand level (HPFP) from the electronic controller 160 for the high pressure fuel pump 130 is shown. Prior to T0 the level is dependent upon the torque demand requested of the engine 10. During the overrunning period 'T' from T0 to Te the demand level is set to a high demand level and, in the example shown, to the maximum possible demand level (100%). At the end of the over-run period T that is to say after Te, the demand level is initially set to a low demand level which in this case is zero and then after a period of time T, has expired is returned to a demand level required to fuel the engine 10 to meet the current torque demand from the engine 10 because the fuel stored in the accumulator 140 has been exhausted.

In FIG. 7C the fuel loading of the accumulator 140 is shown. Prior to T0 it is assumed that the fuel accumulator is empty and so the loading is 0%, it will be appreciated that the actual level will be dependent upon whether fuel previously stored remains in the accumulator 140.

During the overrunning period 'T' from T0 to Te the fuel loading Fs in the accumulator will increase due to the pumping of fuel into the accumulator 140 from the high pressure fuel pump 130 currently set to a high demand level. At the end of the over-run period T, that is to say after Te, fuel is drawn from the accumulator 140 to fuel the engine 10 and so the fuel loading Fs of the accumulator 140 begins to fall and, after T1 seconds have elapsed, the fuel loading of the accumulator 140 is exhausted and in this case the fuel loading is 0%. It will be appreciated that in some cases the amount of fuel stored in the accumulator 140 may be more than that required to fuel the engine 10 during the period of acceleration and so at the end of the period of acceleration fuel will remain in the accumulator 140. In the example shown the acceleration is continuing past the time period T1 where the accumulator 140 is exhausted thereby requiring the high pressure fuel pump 130 to be used to supply fuel to the engine 10 (as shown in FIG. 7B) and so the valve member 192 is commanded by the electronic controller 160 to adopt the position shown in FIG. 10A so as to once more connect the high pressure fuel pump 130 to the common fuel rail 150 thereby facilitating the supply of fuel from the high pressure fuel pump 130 to the common fuel rail 150.

The quantity of fuel required to be supplied from the fuel injectors I1, I2, I3 and I4 is shown in FIG. 7D. Prior to time T0 the quantity of fuel is that required to meet the torque demand placed upon the engine 10. In the overrunning period 'T' starting at T0 and ending at Te substantially no fuel is required to be supplied to the engine 10 and then after Te the quantity of fuel required increases to meet the torque demand required to accelerate the motor vehicle 50. It will be appreciated that, in the time period T1 following Te, the fuel is supplied not by the high pressure fuel pump 130 but from the accumulator 140.

In a case where a signal from the fuel pressure sensor 180 associated with the accumulator 140 indicates that a maximum safe operating pressure for the accumulator 140 has been reached before the overrunning period 'T' ends, fuel may be vented back to the fuel tank 110 via the return line HPR but, in order to prevent a large quantity of fuel from wastefully being returned to the fuel tank 110, the high pressure fuel pump is switched by the electronic controller 160 to a low demand level and preferably to a zero demand level so that there is a minimal return flow to the fuel tank 110.

Operation of the fuel supply systems shown in FIGS. 4 to 6 is operationally the same as that described with reference to FIG. 3. Prior to time T0 the high pressure fuel pump 130 is in each case operated to meet the torque demand of the engine 10 and the respective valve means 190A, 190B, 290 are controlled by the electronic controller 160 to permit fuel to flow from the high pressure fuel pump 130 to the common fuel rail 150 but prevent flow to the accumulator 140.

That is to say, for FIG. 4, the valve 190A is open between the high pressure fuel pump 130 and the common fuel rail 150 but closed between the accumulator 140 and the common fuel rail 150 and the valve 190B is closed. For FIG. 5, the valve 190A is open between the high pressure fuel pump 130 and the common fuel rail 150 but closed between the high pressure fuel pump 130 and the accumulator 140 and the valve 190B is closed between the accumulator 140 and the common fuel rail 150 and, for FIG. 6, the valve 290 is closed.

In the overrunning time period 'T' starting at T0 and ending at Te the high pressure fuel pump 130 is in each case set to a high demand level and the respective valve means 190A, 190B, 290 is controlled by the electronic controller 160 to permit fuel to flow from the high pressure fuel pump 130 to the accumulator 140 but prevent flow to the common fuel rail 150.

That is to say, for FIG. 4, the valve 190B is open to the accumulator 140 and closed to the valve 190A, the valve 190A is closed between the high pressure fuel pump 130 and the common fuel rail 150. For FIG. 5, the valve 190A is open between the high pressure fuel pump 130 and the accumulator 140 but closed between the high pressure fuel pump 130 and the common fuel rail 150 and the valve 190B is closed between the accumulator 140 and the common fuel rail 150 and, for FIG. 6, the valve 290 is open between the common fuel rail 150 and the accumulator 140.

Then in the acceleration period starting at time Te and persisting for a time period T1, the high pressure fuel pump 130 is operated at a low demand level such as 0% by the electronic controller 160 and the valve means 190A, 190B and 290 are operated to permit fuel to flow from the accumulator 140 to the common fuel rail 150 but prevent the flow of fuel from the high pressure fuel pump 130 to the common fuel rail 150.

That is to say, for FIG. 4, the valve 190B is closed to flow from the high pressure fuel pump 130 to the accumulator 140 and open to flow from the accumulator 140 to the valve 190A and the valve 190A is closed between the high pressure fuel pump 130 and the common fuel rail 150 but open between the valve 190B and the common fuel rail 150. For FIG. 5, the valve 190A is closed for all flow from the high pressure fuel pump 130 and the valve 190B is opened between the accumulator 140 and the common fuel rail 150 and, for FIG. 6, the valve 290 is open between the common fuel rail 150 and the accumulator 140.

After time T1 has expired there is no longer, in the case of this example, any fuel left in the accumulator 140 and so the valves 190A, 190B and 290 and the high pressure fuel pump 130 revert to the operating conditions present prior to the time T0. That is to say, the valves 190A, 190B and 290 permit fuel to flow from the high pressure fuel pump 130 to the common fuel rail 150 but isolate the accumulator 140 from the high pressure fuel pump 130 and the common fuel rail 150 and the high pressure fuel pump 130 is operated at a demand level required to meet the torque demand for the engine 10.

Figure 8:
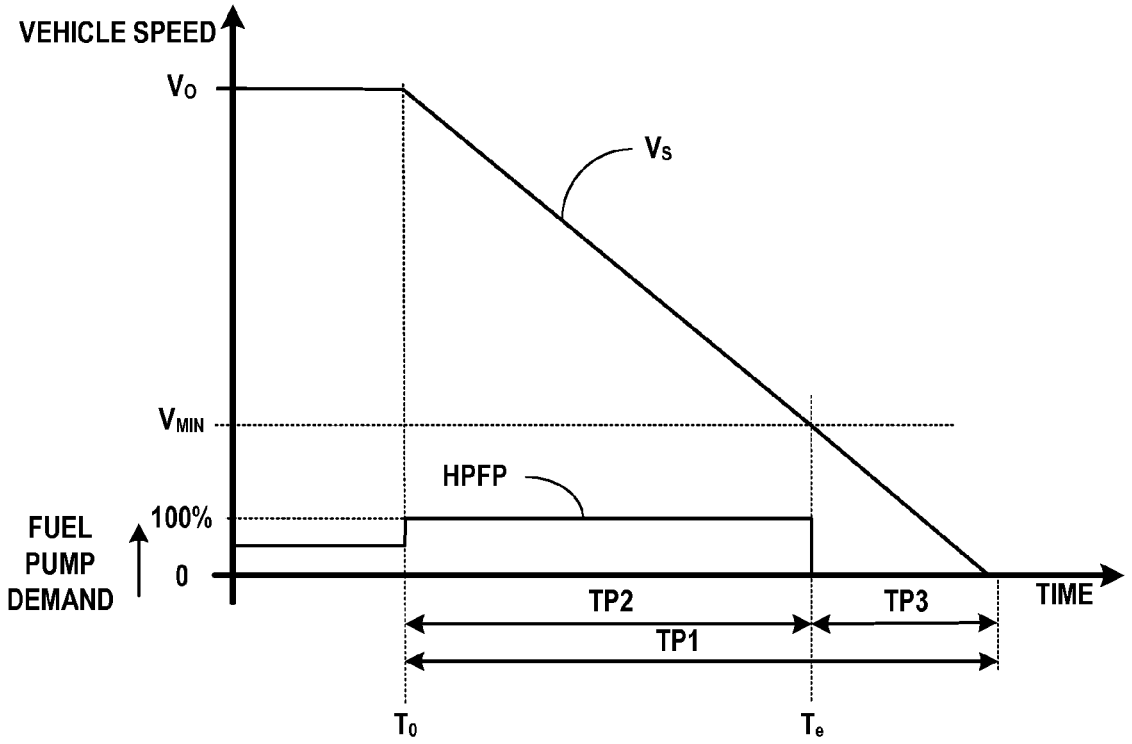
FIG. 8 is a time chart showing the relationship between vehicle speed and fuel pump demand during a vehicle stop.

FIG. 8 shows a relationship between motor vehicle speed and high pressure fuel pump demand versus time during an overrunning event that ends with a zero vehicle speed and for which energy recuperation via electric means is also provided. For example, during an overrunning event, a hybrid vehicle can recover energy by operating a motor such as the motor 24 as a generator and recharging an electric storage device such as the battery 26.

The overrunning event commences at time T0 and persists for a time period 'TP1' when the motor vehicle 50 is stationary. However, in this case the recovery of energy from the motor vehicle 50 by the use of the fuel supply system 100 ends at time Te when the speed of the motor vehicle 50 has fallen to a predefined minimum speed Vmin.

Therefore, in this case, the period during which energy recovery via the fuel system 100 persists for is TP2 which is less than the time period TP1 by a time period of TP3 seconds.

For a motor vehicle having a conventional fuel supply system, below a minimum vehicle speed Vmin (≈20 km/h) the kinetic energy of the motor vehicle 50 is no longer sufficient to overcome engine friction and other engine loads as well as having surplus energy that can be captured and stored by an electrical recuperation system. This is partly because the load applied to the engine driving the high pressure fuel pump is considerable. Therefore it is usual for electric recuperation to stop when the vehicle speed reaches Vmin. However, continued electric recuperation during the time period TP3 is made possible by the use of a fuel supply system constructed in accordance with the present disclosure by operating the high pressure fuel pump 130 at a low and preferably zero demand. Therefore more electric energy can be recuperated giving a potentially enhanced fuel economy because more electrical energy is stored for use in driving the motor vehicle 50 at a later time.

Figure 9A:
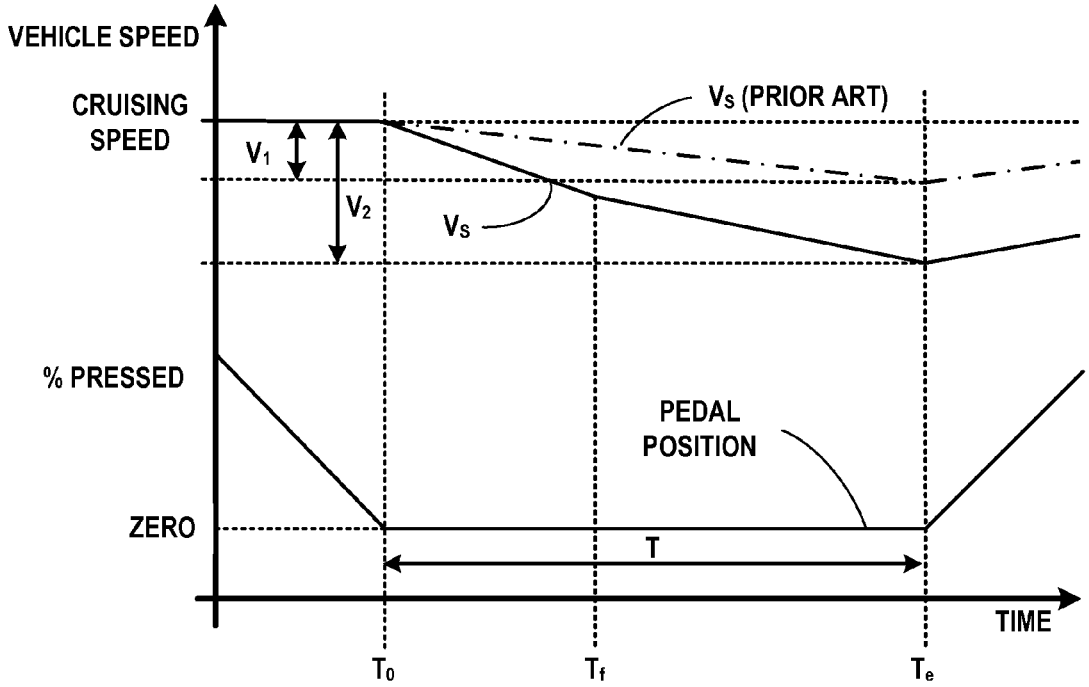
FIGS. 9A to 9C are time charts for a vehicle slow down and subsequent period of acceleration in a case where a fuel accumulator of the fuel supply system is filled prior to the period of slowing ending.
Figure 9B:
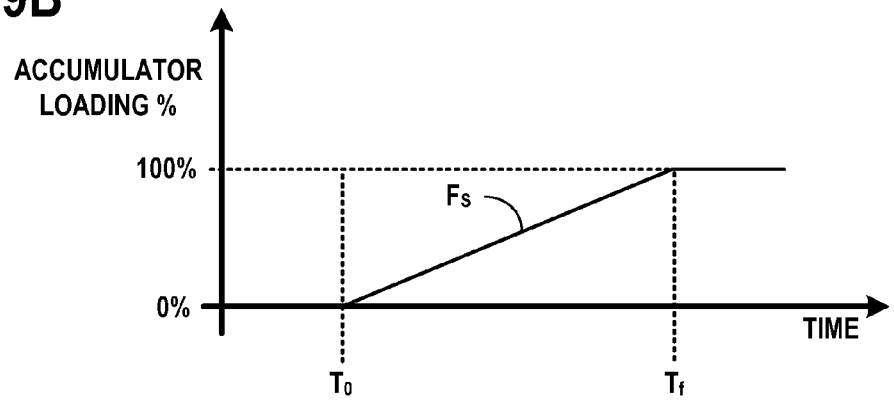
Figure 9C:
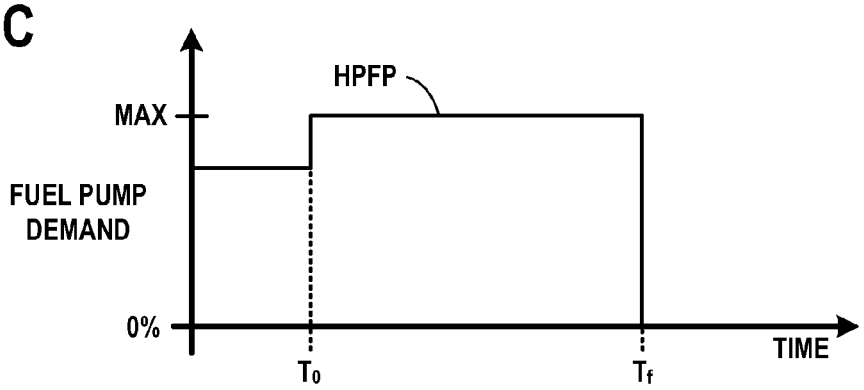

With reference to FIGS. 9A to 9C there is shown a vehicle over-run event that is in many ways the same as that shown in FIGS. 7A to 7C but differs in that, in this case, the accumulator 140 is full before the over-run event has finished.

In FIG. 9A the variation in speed of the motor vehicle 50 is shown for an over-run event that lasts for a period of time 'T' starting at the time T0 and ending at the time Te.

The vehicle speed Vs of the motor vehicle 50 utilizing a fuel supply system in accordance with the present disclosure is shown along with the case for a conventional motor vehicle indicated on FIG. 9A as Vs (Prior Art). It can be seen that by increasing the high pressure fuel pump demand during an over-run event the rate of deceleration of the motor vehicle 50 has been increased compared to a prior art case as indicated by the change in speed V2 compared to the change in speed V1 for the prior art case. In this case the over-run event starts when the position of an accelerator pedal (e.g., Pedal Position) of the motor vehicle 50 is sensed to be zero and ends when the position of the accelerator pedal has moved from zero to a pressed position.

As shown in FIGS. 9B and 9C in the period from T0 to Tf the high pressure fuel pump is operated at a high demand level and in this case is the maximum demand level available (100%). However at time Tf the fuel loading (Fs) of the accumulator 140 has reached 100% and so the accumulator 140 is full and cannot accommodate any more fuel. Therefore, in order to prevent a large quantity of fuel from wastefully being returned to the fuel tank 110, the high pressure fuel pump is switched by the electronic controller 160 to a low demand level and preferably to a zero demand level so that there is a minimal return flow to the fuel tank 110.

It will be appreciated that this switching from high to low demand corresponds to method boxes 1.7 and 1.8 on FIG. 1.

It will also be appreciated that, when the high pressure fuel pump 130 is switched to the low demand level, an increased opportunity for electrical energy recovery is provided.

Therefore in summary, the present disclosure provides a method and fuel supply system that can recover useful energy during overrunning conditions and convert the recovered energy into a supply of fuel stored at high pressure in an accumulator for use in fuelling the engine at a later point in time. In this manner fuel is saved when filling the accumulator because no power has to be produced by the engine to drive the high pressure fuel pump 130 and fuel is also saved when using the fuel stored in the accumulator 140 to fuel the engine 10 because the high pressure fuel pump 130 does not have to be driven by the engine 10 to provide fuel to the engine 10 during this period of time.

A further advantage of the present disclosure is that it increases the opportunities for recovering energy during an over-run period in the case of a hybrid electric vehicle.

It will be appreciated by those skilled in the art that although the present disclosure has been described by way of example with reference to one or more embodiments it is not limited to the disclosed embodiments and that alternative embodiments could be constructed without departing from the scope of the present disclosure as defined by the appended claims.

Note that the example control and estimation routines included herein can be used with various engine and/or vehicle system configurations. The control methods and routines disclosed herein may be stored as executable instructions in non-transitory memory. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of recuperating energy from a motor vehicle, comprising:

during a vehicle over-run event wherein substantially no fuel is supplied to an engine, operating a high pressure fuel pump at a high demand level to store fuel in an accumulator, the high pressure fuel pump being engine driven and operable at least at high and low demand levels, and the accumulator being selectively connectable to the high pressure fuel pump and the engine, and during the vehicle over-run event, operating the high pressure fuel pump at the high demand level if a speed of the motor vehicle is above a predefined minimum vehicle speed and operating the high pressure fuel pump at the low demand level if the speed of the motor vehicle is below the predefined minimum vehicle speed.

2. The method of claim 1, wherein the high demand level is a maximum demand level of the high pressure fuel pump, the maximum demand level selected to deliver a maximum flow of fuel from the high pressure fuel pump based on an engine speed.

3. The method of claim 1, further comprising supplying fuel from the accumulator to the engine during a subsequent engine fuel demand event and operating the high pressure fuel pump at the low demand level during a period in which fuel is supplied from the accumulator to the engine.

4. The method of claim 3, wherein the subsequent engine fuel demand event is an event in which fuel is used by the engine to accelerate the motor vehicle.

5. The method of claim 1, wherein the low demand level is a minimum demand level of the high pressure fuel pump.

6. The method of claim 1, further comprising, during the vehicle over-run event, reducing a demand level for the high pressure fuel pump from the high demand level to the low demand level if the accumulator is full.

7. A motor vehicle with a fuel supply system, comprising:

an engine;

a fuel reservoir;

a low pressure fuel pump to supply fuel from the reservoir to an engine driven variable output high pressure fuel pump operable at least at high and low demand levels;

at least one fuel injector to supply fuel at high pressure to the engine;

a fuel accumulator to store fuel at high pressure;

a valve means to control a flow of fuel between the high pressure fuel pump, the accumulator, and the engine; and an electronic controller to control an operation of the high pressure fuel pump, the valve means and the at least one fuel injector, wherein the electronic controller is operable during a vehicle over-run event in which substantially no fuel is supplied to the engine, to operate the high pressure fuel pump at the high demand level while controlling the valve means to supply fuel from the high pressure fuel pump to the fuel accumulator, wherein, during the vehicle over-run event, the electronic controller operates the high pressure fuel pump at the high demand level if a speed of the motor vehicle is above a predefined minimum vehicle speed, and operates the high pressure fuel pump at the low demand level if the speed of the motor vehicle is below the predefined minimum vehicle speed.

8. The fuel supply system of claim 7, wherein the high demand level is a maximum demand level of the high pressure fuel pump, the maximum demand level selected to deliver a maximum flow of fuel from the high pressure fuel pump based on an engine speed.

9. The fuel supply system of claim 7, wherein, during a subsequent engine fuel demand event, the valve means is controlled by the electronic controller to supply fuel from the accumulator to the engine, and the high pressure fuel pump is operated by the electronic controller at the low demand level during a period in which fuel is being supplied from the accumulator to the engine.

10. The fuel supply system of claim 9, wherein the subsequent engine fuel demand event is an event in which fuel is used by the engine to accelerate the motor vehicle.

11. The fuel supply system of claim 7, wherein the low demand level is a minimum demand level of the high pressure fuel pump.

12. The fuel supply system of claim 7, wherein, during the vehicle over-run event, the electronic controller is further operable to reduce the demand level for the high pressure fuel pump from the high demand level to the low demand level if the accumulator is full.

13. The fuel supply system of claim 7, wherein the accumulator comprises a body defining a flow passage by which fuel can enter or leave a storage volume defined by a cup shaped piston, a metal bellows and the body, wherein the piston supports the bellows and is slidingly supported by the body, and wherein a spring biases the piston towards an end of the body at which fuel enters or leaves the storage volume via the flow passage, the bellows being sealed to both the body and the piston.

14. A motor vehicle with an engine, comprising:

at least one electrical traction motor to assist with driving of the motor vehicle; and an electrical generator to recuperate energy from the motor vehicle while storing the energy for subsequent use by the at least one electrical traction motor, wherein when a speed of the motor vehicle is above a predefined minimum vehicle speed, a fuel supply system is used during a vehicle over-run event to recuperate energy from the motor vehicle by operating a high pressure fuel pump at a high demand level to store fuel in an accumulator while the electrical generator is simultaneously used to recuperate energy from the motor vehicle; and when the speed of the motor vehicle is below the predefined minimum vehicle speed, the high pressure fuel pump operates at a low demand level during the over-run event while the electrical generator is used to recuperate energy from the motor vehicle and store the recuperated energy as electrical energy.

15. The motor vehicle of claim 14, wherein the electrical traction motor and the electrical generator are provided by a single electrical machine.

16. The motor vehicle of claim 14, wherein the high demand level is a maximum demand level of the high pressure fuel pump, and wherein the maximum demand level is selected to deliver a maximum flow of fuel from the high pressure fuel pump based on an engine speed.

17. The motor vehicle of claim 14, wherein, during a subsequent engine fuel demand event that is used to accelerate the motor vehicle, a valve means is controlled by an electronic controller to supply fuel from the accumulator to the engine, and the high pressure fuel pump is operated by the electronic controller at the low demand level during a period in which fuel is being supplied from the accumulator to the engine.

18. The motor vehicle of claim 14, wherein an electronic controller is operable to reduce a demand level for the high pressure fuel pump from the high demand level to the low demand level if the accumulator is full during the vehicle over-run event.

* * * * *